US006619595B2

(12) United States Patent
Hinokio

(10) Patent No.: US 6,619,595 B2
(45) Date of Patent: Sep. 16, 2003

(54) REAR TRAY HAVING SPEAKER GRILL AND METHOD FOR INSTALLING SPEAKER GRILL AND REAR TRAY TO VEHICLE PANEL

(75) Inventor: Tadahiro Hinokio, Shioya-gun (JP)

(73) Assignee: TS Tech Co., Ltd., Asaka (JP)

( * ) Notice: Subject to any disclaimer, the term of this patent is extended or adjusted under 35 U.S.C. 154(b) by 0 days.

(21) Appl. No.: 10/189,625

(22) Filed: Jul. 8, 2002

(65) Prior Publication Data

US 2003/0025045 A1 Feb. 6, 2003

(30) Foreign Application Priority Data

Aug. 3, 2001 (JP) ..... 2001-236628

(51) Int. Cl.[7] ..... G12B 9/00
(52) U.S. Cl. ..... 248/27.1
(58) Field of Search ..... 248/27.1, 27.3; 381/188; 181/141, 150, 171, 172

(56) References Cited

U.S. PATENT DOCUMENTS

| | | | | | |
|---|---|---|---|---|---|
| 4,032,725 | A | * | 6/1977 | McGee | 381/395 |
| 4,267,993 | A | * | 5/1981 | Shimizu et al. | 248/27.1 |
| 4,277,653 | A | * | 7/1981 | Pawelzick | 381/395 |
| 4,546,850 | A | * | 10/1985 | Litner | 181/141 |
| 5,273,243 | A | * | 12/1993 | Abdallah et al. | 248/27.1 |
| 5,414,229 | A | * | 5/1995 | Rocheleau et al. | 181/150 |
| 6,305,892 | B1 | * | 10/2001 | Qiao | 411/508 |

* cited by examiner

*Primary Examiner*—Ramon O. Ramirez
(74) *Attorney, Agent, or Firm*—Oliff & Berridge, PLC

(57) ABSTRACT

A rear tray having a speaker grill, for being installed in a panel body of a vehicle rear portion, has an engaging hole provided on the rear tray; and a clip attachment member for being engaged to the engaging hole, the clip attachment member being provided on a rear face of the speaker grill. The speaker grill is fixed to the rear tray beforehand by engaging the clip attachment member to the engaging hole.

7 Claims, 4 Drawing Sheets

REAR TRAY HAVING SPEAKER GRILL AND METHOD FOR INSTALLING SPEAKER GRILL AND REAR TRAY TO VEHICLE PANEL

BACKGROUND OF THE INVENTION

1. Field of the Invention

The present invention relates to a rear tray having a speaker grill, for being installed in a vehicle panel at a rear portion of an automobile.

2. Description of Related Arts

Recently, it is general to carry an audio product in an automobile. A speaker is mostly attached to a so-called rear tray installed between a rear seat and a rear window glass. In this case, a round hole is opened on the rear tray and a loudspeaker unit is arranged under it. Then, a speaker grill is attached on the upper face of the round hole.

Incidentally, as a method for attaching the rear tray and the speaker grill to the vehicle panel, there is a method, for example, as shown in FIG. 7, that a rear tray 200 is attached to a panel body 100 beforehand and thereafter a speaker grill 150 is attached. As shown in FIG. 8, for example, a clip 250 is mounted in a hole 300 on the rear face of the speaker grill 150, and the speaker grill 150 is fixed by pushing the clip 250 into the panel body 100.

However, in the method for attaching in earlier technology, since the rear tray is mounted on the panel body beforehand and then the speaker grill is fixed at the next, there is a trouble in assembling of the rear tray and the speaker grill.

SUMMARY OF THE INVENTION

An object of the present invention is to provide a rear tray having a speaker grill, which can be attached easily to a vehicle panel.

In order to solve the above-described problems, according to a first aspect of the present invention, the rear tray having a speaker grill, for being installed in a panel body of a vehicle rear portion, comprises: an engaging hole provided on the rear tray; and a clip attachment member for being engaged to the engaging hole, the clip attachment member being provided on a rear face of the speaker grill; wherein the speaker grill is fixed to the rear tray beforehand by engaging the clip attachment member to the engaging hole.

Preferably, a projecting portion is provided on a vertical wall portion of the clip attachment member, and the projecting portion is engaged with the engaging hole.

Further, a cut-out portion is preferably provided on a bottom portion of the clip attachment member.

The rear tray may have a substantially rectangular shape.

Further, the engaging hole may have a substantially isosceles triangle shape.

Moreover, the projecting portion may have a polygonal shape.

According to the present invention, the engaging hole is provided in the vehicle rear portion, and the clip attachment member for being engaged to the engaging hole is provided on the rear face of the speaker grill for covering a speaker. The speaker grill is fixed to the rear tray beforehand by engaging the clip attachment member to the engaging hole. Therefore, it can be carried in a state that the speaker grill is mounted to the rear tray beforehand. Moreover, mounting it to the vehicle panel can be performed by one step. Thus, assembling of the speaker grill and the rear tray is extremely easy.

Further, the projecting portion is preferable to be provided on the vertical wall portion of the clip attachment member. Therefore, the speaker grill can be fixed firmly to the rear tray, and the speaker grill can be prevented from falling from the rear tray when it is carried.

Moreover, since the cut-out portion may be provided on the bottom portion of the clip attachment member, a clip can be fixed easily to the speaker grill beforehand.

According to a second aspect of the present invention, the rear tray having a speaker grill, comprises: an engaging hole provided on the rear tray; a clip attachment member having a projecting portion for being engaged to the engaging hole when the speaker grill is attached to the rear tray, the clip attachment member being provided on a rear face of the speaker grill; and a cut-out portion capable of mounting a clip for installing the rear tray having the speaker grill to a vehicle panel, the cutout portion provided on a bottom portion of the clip attachment member.

According to a third aspect of the present invention, the method for installing a speaker grill and a rear tray to a vehicle panel, comprises: inserting a clip attachment member provided on a rear face of the speaker grill into an engaging hole provided on the rear tray; fixing the speaker grill to the rear tray by engaging a projecting portion provided on the clip attachment member with the engaging hole at a rear face of the rear tray; and attaching a clip to the clip attachment member after the fixing.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein.

PREFERRED EMBODIMENT OF THE INVENTION

Hereinafter, an embodiment according to the present invention will be explained with reference to FIGS. 1 to 5.

Speaker grills 1 according to the embodiment are attached so as to cover a vehicle speaker for being attached to a rear tray 20 of a panel body installed between a rear seat and a rear window glass.

Figure 1:
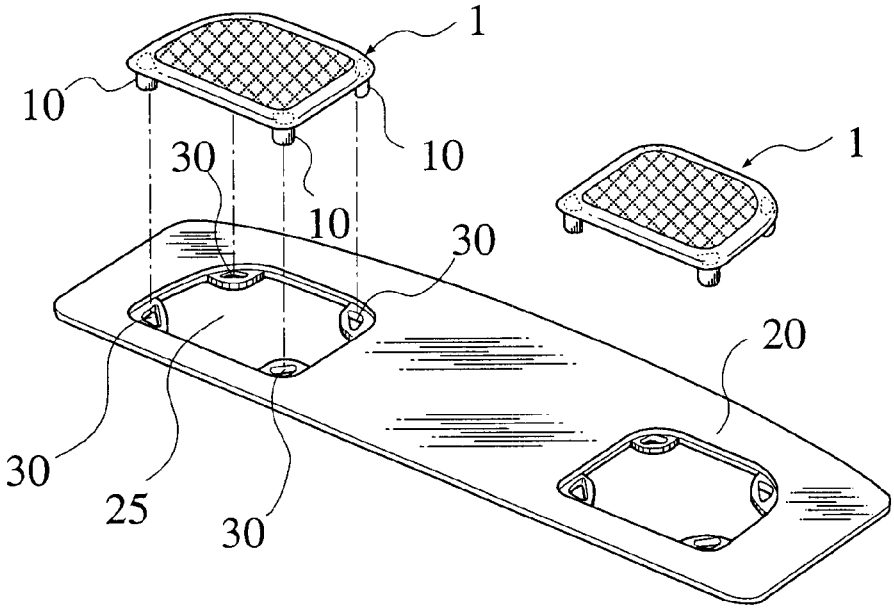
FIG. 1 is a perspective view showing a condition of mounting speaker grills according to an embodiment of the present invention in a rear tray.

FIG. 1 is a perspective view showing a condition of mounting the speaker grills 1 according to the present invention to the rear tray 20.

The rear tray 20 comprises a base member which is substantially rectangular in a plane view, and a covering member stuck to the surface of the base member. As a material of the base member, for example, the one formed by using a fibrous material, concretely, a K-Plasheet (KP sheet: made by K-Plasheet Corporation) which is a molding material of polyester fiber, or the like is used. Further, as the covering member, the one including a nonwoven fabric, or a vinyl chloride (polyvinyl chloride) resin is given.

At symmetrical positions on the surface of the rear tray 20, opening portions 25 which are polygonal in a plane view are formed, and a speaker is installed in the opening portions 25. Further, at the position in vicinity of the opening portions 25, engaging holes 30 which are isosceles triangle in a plane view are formed.

Here, each edge of the engaging holes 30 are cut out in circular arc-like. The edge provided at the corner portion position of each speaker grill 1 is a gradually circular arc-like obtuse angle, and the other two edges have identical circular arc-like. Further, clip attachment members 10 will be inserted into the engaging portions 30 in a state that the curved portion of the rear side of its vertical wall portion 11 abuts the obtuse angle.

As shown in FIG. 1, in four corners of the rear face of each speaker grill 1, the clip attachment members 10 are attached. In addition, the body of each speaker grill 1 and the clip attachment members 10 are molded integrally by a die.

Figure 2:
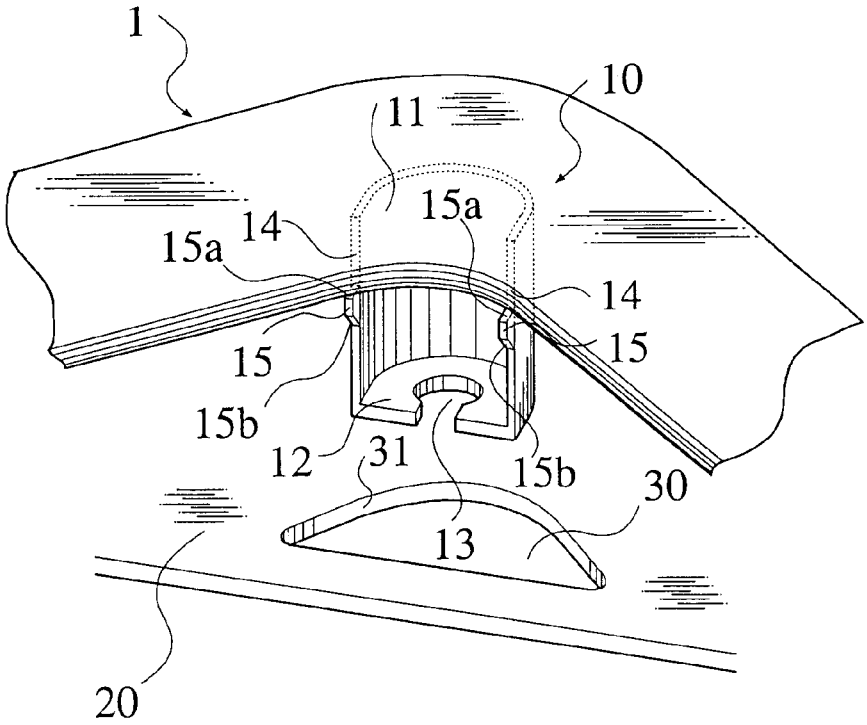
FIG. 2 is a perspective view showing a clip attachment member for mounting to a rear face of the above-described speaker grill.
Figure 3:
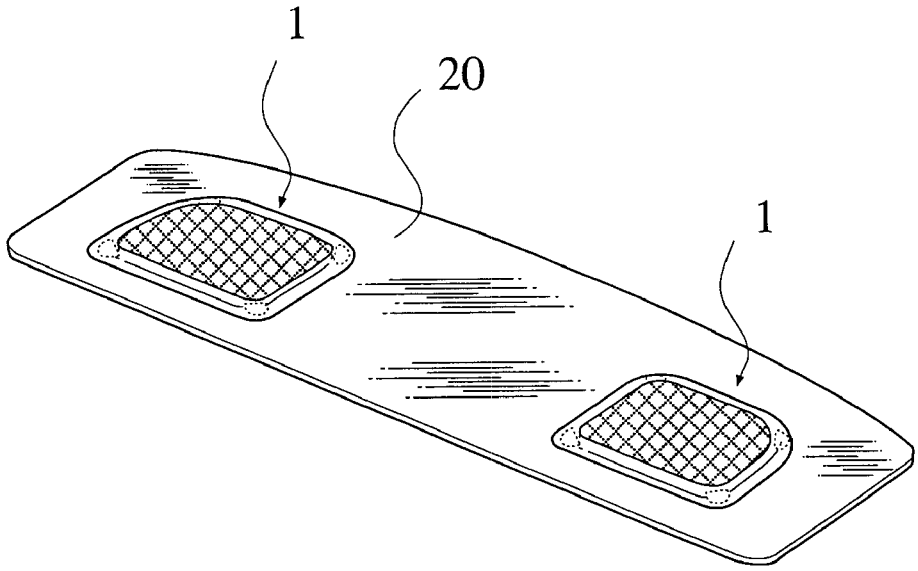
FIG. 3 is a perspective view showing a state that the speaker grills according to the embodiment of the present invention are mounted to the rear tray.

As shown in FIG. 2, the speaker grill 1 and the clip attachment members 10 are integrally molded product made of resin, for example, made of polypropylene (PP). Each clip attachment members 10 is formed in semi-circular in plane view, and comprise a bottom wall portion 12 (a bottom portion). The upper portion thereof is formed integrally with the body of the speaker grill 1.

In the bottom wall portion 12, a key hole-like cut-out portion 13 is formed. The cut-out portion 13 is formed by a round-shaped hole provided almost in the middle of the bottom wall portion 12, and by a taper portion widening gradually from a portion of the hole toward an open end.

Then, on the opening side end 14 in the right and left of the clip attachment members 10 of the speaker grill 1, projecting portions 15 are formed.

The projecting portions 15 are provided almost in the middle of the opening side end 14 of the clip attachment members 10. The projecting portions 15 have inclined faces 15*a* and 15*b* that become gradually high from the lowest portion in both up and down of the projecting portions 15 toward the forward. That is, the projecting portions 15 have two inclined faces 15*a* and 15*b* that incline gradually from the opening side ends 14 toward the direction apart from the opening side ends 14 so as to come close to each other. Further, the top portion of the projecting portions 15 is formed almost in parallel to the opening side end 14. That is, the projecting portions 15 have a trapezoid shape.

In addition, the projecting portions 15 may only be able to regulate the movement of each speaker grill 1 when the clip attachment members 10 of each speaker grill 1 are attached to the engaging holes 30 of the rear tray 20. Its shape or the like is not limited to trapezoid. It may be other polygon, or it may be a shape of a recess, a groove or the like. Further, in the embodiment, the projecting portions 15 are provided on the opening side end 14 of the vertical wall portion 11, however, they may be provided at a portion other than the opening side end 14.

Next, a method for mounting the speaker grill 1 on the rear tray 20 will be explained.

When the speaker grills 1 are mounted on the rear tray 20, each speaker grill 1 is inserted along the inner wall face 31 of the engaging holes 30 from the outside (which is the upper side in FIGS. 1 and 2) of the engaging holes 30. Then, the clip attachment members 10 provided in four corners of each speaker grill 1 are moved in the same rate. In this case, they are inserted so that the horizontal plane of the speaker grills 1 and the horizontal plane of the rear tray 20 are parallel. Thus, the clip attachment members 10 are inserted into the engaging holes 30, and the clip attachment members 10 are inserted along the engaging holes 30 until the speaker grills 1 contact with the rear tray 20.

Here, the projecting portions 15 are formed on the opening side ends 14 of the vertical wall portion 11 of each clip attachment member 10. The projecting portions 15 have inclined faces 15*a* and 15*b* that become gradually high from the lowest portion, that is, the projecting portions 15 have two inclined faces 15*a* and 15*b* that incline gradually from the opening side ends 14 toward the direction apart from the opening side ends 14 so as to come close to each other, respectively. Therefore, the inner wall face 31 of each engaging hole 30 gets on the inclined faces 15*a* and 15*b*, and moves smoothly to the upper portion of each clip attachment member 10 when the clip attachment members 10 are inserted into the engaging holes 30.

Further, the key hole-like cut-out portion 13 is provided on the bottom wall portion 12 of each clip attachment member 10. Therefore, the clip 50 can be fixed easily to the speaker grill 1 beforehand.

Figure 4:
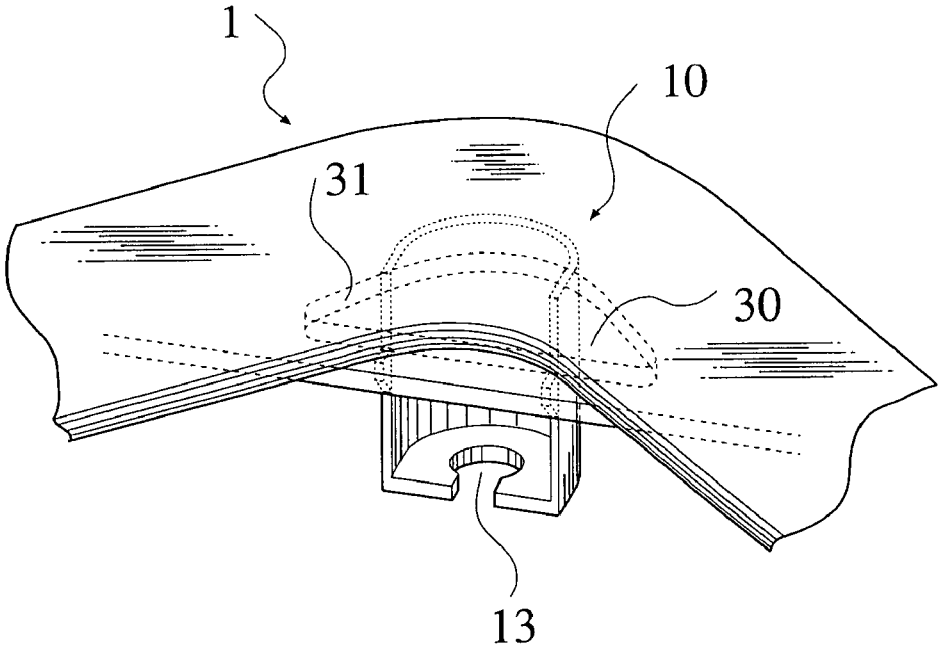
FIG. 4 is a view showing a state that the above-described clip attachment member is mounted to the rear tray.
Figure 5:
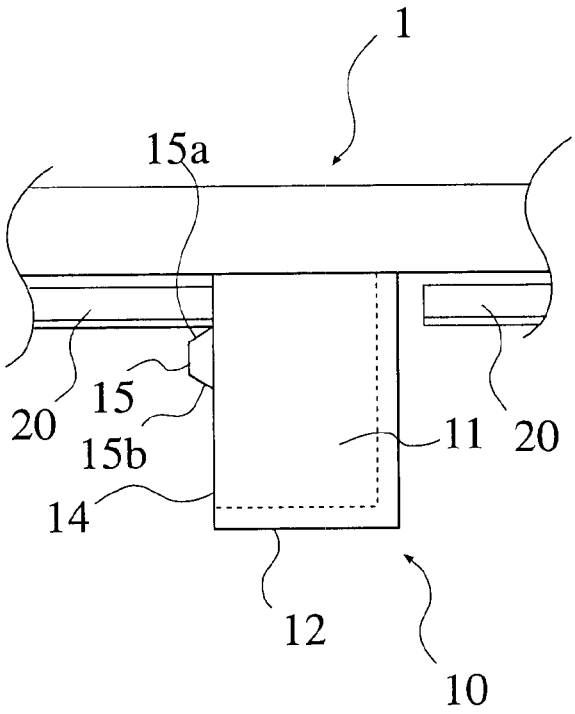
FIG. 5 is a vertically sectional view showing the above-described clip attachment member.

Then, as shown in FIGS. 4 and 5, in a state that each clip attachment member 10 is mounted on the rear tray 20, the rear tray 20 is engaged in a state that the front and rear faces of the rear tray 20 are sandwiched between the projecting portions 15, which are in the right and left of each clip attachment member 10, and the rear face of the speaker grill 1. Therefore, the movement such that the speaker grill 1 gets out of each engaging hole 30 of the rear tray 20 can be prevented certainly.

Therefore, when carrying, it is possible to prevent the speaker grill 1 from falling from the rear tray 20.

Figure 6:
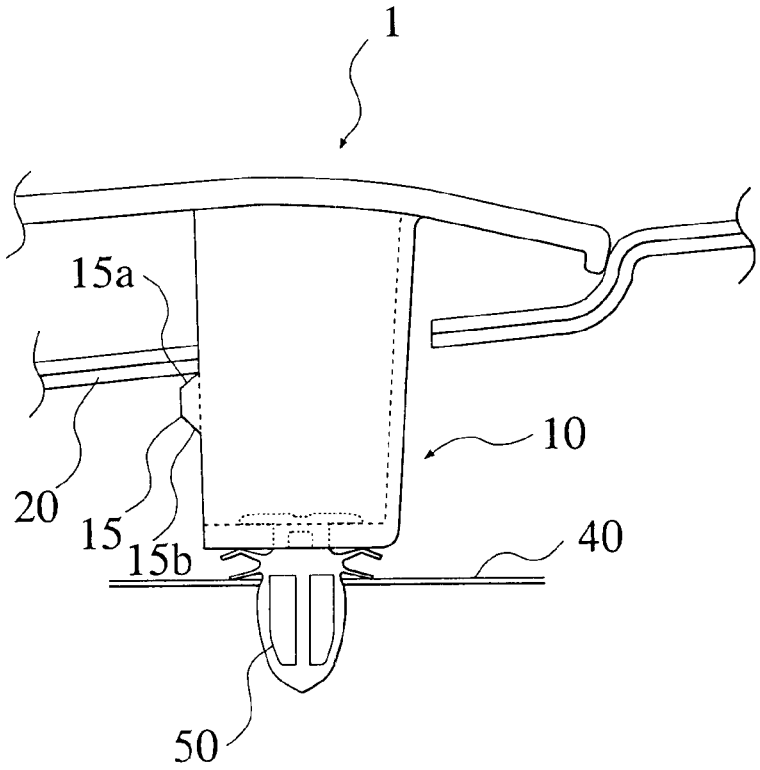
FIG. 6 is a view showing a state that one of the above-described speaker grill and the rear tray are assembled to the vehicle panel.
Figure 7:
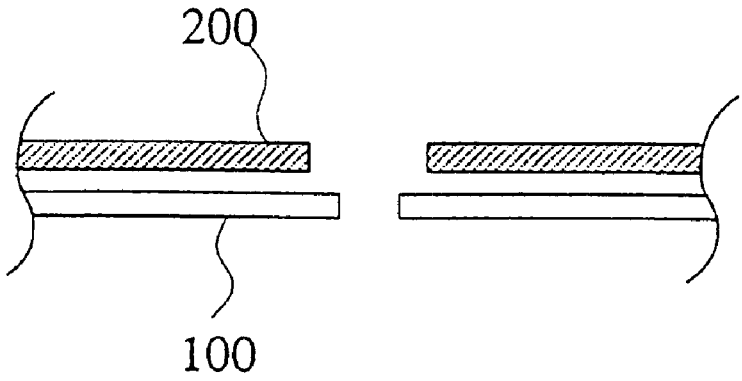
FIG.7 RELATED ART
FIG. 7 is a view showing a method for attaching in earlier technology, which is a vertically sectional view showing a state that a rear tray is mounted to a panel body.
Figure 8:
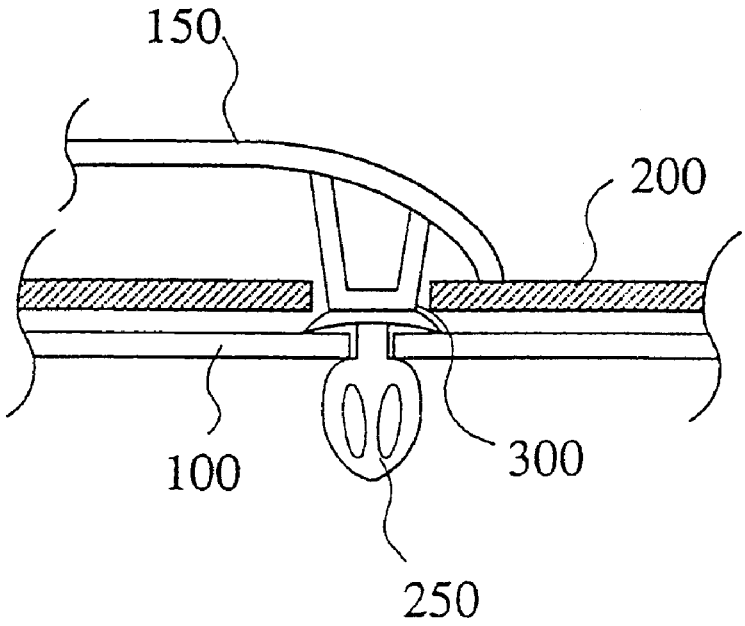
FIG.8 RELATED ART
FIG. 8 is a view showing the method for attaching in the earlier technology, which is a vertically sectional view showing a state that a speaker grill is mounted in the rear tray.

Next, FIG. 6 shows a state that the rear tray 20 in which the speaker grill 1 and the clips 50 are assembled beforehand is mounted on an automotive body panel 40.

Thus, the rear tray 20 in which the speaker grill 1 and the clips 50 are assembled beforehand is pushed into the automotive body panel 40. Thereby, assembling of the speaker grill 1 and the rear tray 20 to the automotive body panel 40 is completed in one time.

Next, a method for detaching the speaker grills 1 from the rear tray 20 will be explained.

When the speaker grills 1 are detached from the rear tray 20, a finger-tip is put on in a minute gap in each speaker grill 1 and the rear tray 20, and it is pushed up to the upper direction (which is an opening direction of the speaker grill 1). Then, the projecting portions 15 of each clip attachment member 10 get on the inner wall face 31 of each engaging hole 31. The projecting portions 15 are pushed out to the front face side of the rear tray 20 by sliding the inner wall face 31. Thus, the engagement of at least one of the clip attachment members 10 is released, so that each speaker grill 1 can be detached easily from the rear tray 30.

Further, in the speaker grills 1, the clip attachment members 20 having undercut portions are provided. Therefore, a slide die is required for its molding. Further, the projecting portions 15 are provided on the opening side ends 14 of each clip attachment member 10. Therefore, a slide die is required also when the projecting portions 15 are molded. However, the undercut portions of the clip attachment members 20 and the projecting portions 15 are provided in the same direction, it is possible to mold them at the same time with one slide die.

Thus, it is possible to reduce the slid die for molding the undercut portion compared with the case that the projecting portions 15 are provided in other part.

Therefore, the structure of the molding die can be simplified rather than that in earlier technology, and costs required for manufacturing a die can be reduced. Further, the number of taking a die can be increased by simplifying the structure of the molding die. Thereby, it is possible to improve the productivity.

As described above, the manufacturing cost of the speaker grills 1 can be reduced.

In addition, in the above embodiment, the speaker grills 1 provided on the rear tray 20 in the rear seat in the back is explained. However, it is not limited to this. The speaker grills 1 may be provided on an arbitrary place in a vehicle other than rear tray 20, such as side doors or the like.

Further, the size and shape of the speaker grills 1 are arbitrary. Moreover, it is needless to say that other concrete detail structures of each member, or the like, can be suitably modified.

What is claimed is:

1. A rear tray having a speaker grill, for being installed in a panel body of a vehicle rear portion, comprising:

an engaging hole provided on the rear tray; and a clip attachment member for being engaged to the engaging hole, the clip attachment member being provided on a rear face of the speaker grill;

wherein the speaker grill is fixed to the rear tray beforehand by engaging the clip attachment member to the engaging hole, and a projecting portion is provided on a vertical wall portion of the clip attachment member, and the projecting portion is engaged with the engaging hole.

2. The rear tray having the speaker grill as claimed in claim 1, wherein a cut-out portion is provided on a bottom portion of the clip attachment member.

3. The rear tray having the speaker grill as claimed in claim 1, wherein the rear tray has a substantially rectangular shape.

4. The rear tray having the speaker grill as claimed in claim 1, wherein the engaging hole has a substantially isosceles triangle shape.

5. The rear tray having the speaker grill as claimed in claim 1, wherein the projecting portion has a polygonal shape.

6. A rear tray having a speaker grill, comprising:

an engaging hole provided on the rear tray;

a clip attachment member having a projecting portion for being engaged to the engaging hole when the speaker grill is attached to the rear tray, the clip attachment member being provided on a rear face of the speaker grill; and a cut-out portion capable of mounting a clip for installing the rear tray having the speaker grill to a vehicle panel, the cut-out portion provided on a bottom portion of the clip attachment member.

7. A method for installing a speaker grill and a rear tray to a vehicle panel, comprising:

inserting a clip attachment member provided on a rear face of the speaker grill into an engaging hole provided on the rear tray;

fixing the speaker grill to the rear tray by engaging a projecting portion provided on the clip attachment member with the engaging hole at a rear face of the rear tray; and attaching a clip to the clip attachment member after the fixing.

* * * * *